United States Patent [19]

Paulfeuerborn

[11] 4,254,593

[45] Mar. 10, 1981

[54] SHOT OR SAND BLASTING MACHINE

[76] Inventor: Clemens Paulfeuerborn, Im Stadtsfeld 6, 4270 Dorsten, Fed. Rep. of Germany

[21] Appl. No.: 94,081

[22] Filed: Nov. 14, 1979

[30] Foreign Application Priority Data

Nov. 27, 1978 [DE] Fed. Rep. of Germany ..... 2851173

[51] Int. Cl.[3] ..... B24C 3/14

[52] U.S. Cl. ..... 51/425; 51/432; 51/DIG. 10

[58] Field of Search ..... 51/424, 425, 431, 432, 51/DIG. 10

[56] References Cited

U.S. PATENT DOCUMENTS

| | | | |
|---|---|---|---|
| 2,935,820 | 5/1960 | Mead | 51/425 |
| 3,097,450 | 7/1963 | Freeman | 51/425 X |
| 3,362,109 | 1/1968 | Wallace | 51/424 |
| 3,385,006 | 5/1968 | Miller | 51/417 X |
| 3,717,957 | 2/1973 | Walker | 51/424 X |

*Primary Examiner*—Gary L. Smith

*Attorney, Agent, or Firm*—H. Dale Palmatier

[57] ABSTRACT

A shot blasting machine for shot blasting wire or rod-like material is of the kind comprising two centrifuge wheels in a closed housing which has an inlet for blasting shot or sand, means for conducting the wire rod material to be blasted through the housing between the centrifuge wheels, and an outlet for scale blasted from the wire or rod material. The centrifuge wheels are rotated in the same direction as each other, the region between the wheels where blasting takes place is divided into two sections by a wall, which permits the passage of the material to be blasted through the region, the shot or sand, in operation passing from one wheel to the other wheel in one section and from the other wheel to the one wheel in the other section, and a guide device being disposed adjacent each centrifuge wheel one in each section to direct the shot or sand from the wheel against the material to be blasted. This arrangement economizes in power because the shot circulates through the two wheels and impinging streams of shot are avoided so that there is no destruction of the energy of the shot, and also the wear of the shot is minimized.

5 Claims, 4 Drawing Figures

Fig.1
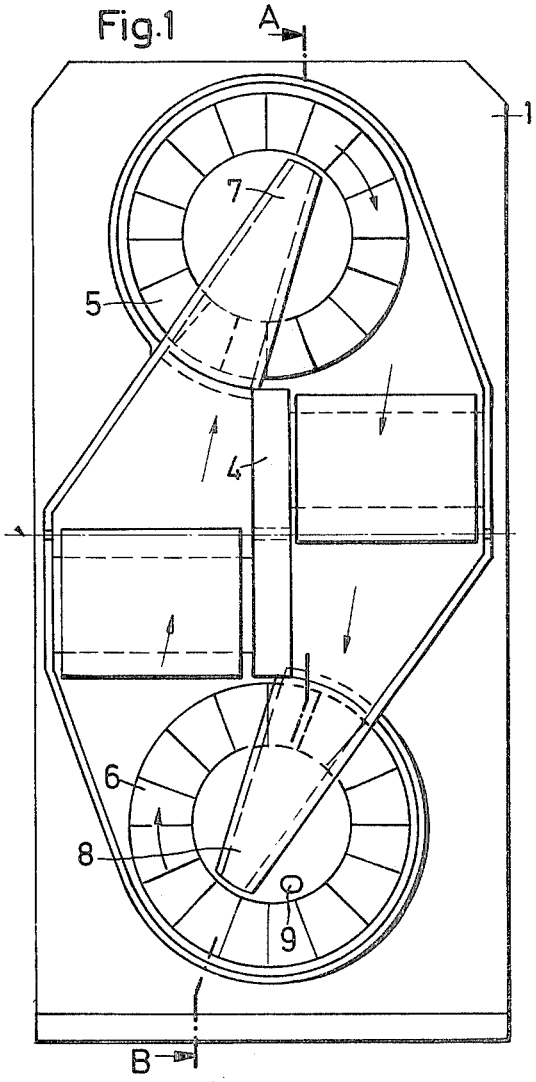
Fig.2 (A-B)
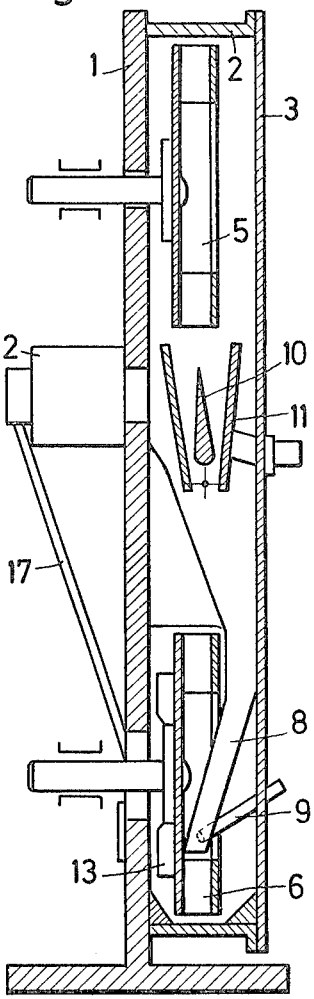
Fig.3
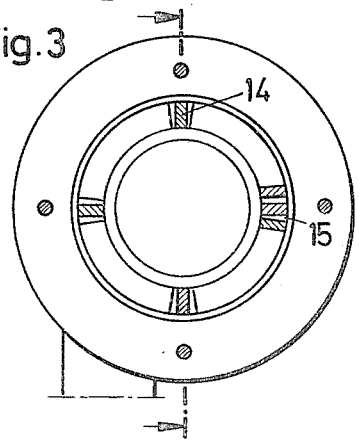
Fig.4
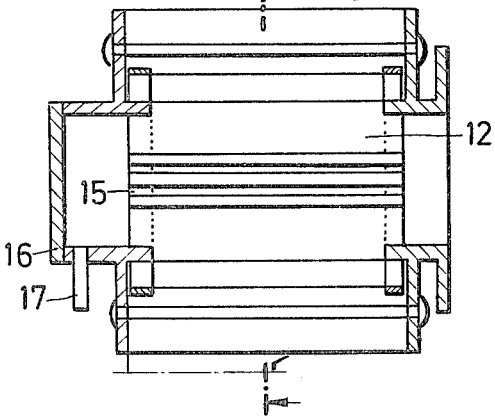

SHOT OR SAND BLASTING MACHINE

BACKGROUND OF THE INVENTION

This invention relates to shot or sand blasting machines for use in shot or sand blasting material in the form of wire or rod, the machine being of the kind comprising two centrifuge wheels in a closed housing which has an inlet for blasting shot or sand, means for conducting the wire or rod material to be blasted through the housing between the centrifuge wheels, and an outlet for scale blasted from the wire or rod material.

In one such machine the two centrifuge wheels are driven in opposite directions from each other, so that the blasting shot or sand from one centrifuge wheel impinges upon the blasting shot or sand from the other centrifuge wheel approximately in the region in which the wire or rod material is blasted. As a result the energy transmitted by the centrifuge wheels to the blasting shot is continually destroyed. This means that this energy must be repeatably renewed. Furthermore, the blasting shot or sand itself is subject to comparatively high wear. The blasting shot flung out from the centrifuge wheels collects at the bottom of the housing and is conveyed upwards again by an externally situated conveyor and is fed back again to the inlet regions of the centrifuge wheels. Along this transportation route of the shot or sand, scale or other material abraded from the rod or wire is separated from the shot or sand. This arrangement is disclosed in French Patent Specification No. 1,268,599.

A shot blasting machine is also known, in which three centrifuge wheels are arranged in a star pattern staggered from one another around the path of the material to be blasted in the direction of movement of this material. With each centrifuge wheel there is associated a guide device consisting of two adjustable guide plates. The guide devices feed the blasting material issuing from the centrifuge wheels against the material to be blasted. The shot or other blasting material here again collects in the lower region of the housing and must be supplied thence to the centrifuge wheels by separate conveyors. This machine is described in German Specification No. 1,815,187.

The main object of the present invention is to provide a shot blasting machine of the kind initially described which can be operated with a lower energy consumption, which is constructed as compactly as possible, and in which minimum wear of the blasting shot or other blasting material takes place.

SUMMARY OF THE INVENTION

According to this invention in such a shot or sand blasting machine, the centrifuge wheels are rotated in the same direction as each other, the region between the wheels where blasting takes place is divided into two sections by a wall, which permits the passage of the material to be blasted through the region, the shot or sand, in operation passing from one wheel to the other wheel in one section and from the other wheel to the one wheel in the other section, and a guide device being disposed adjacent each centrifuge wheel, one in each section to direct the shot or sand from the wheel against the material to be blasted.

Because the centrifuge wheels are rotated in the same direction as each other and the corresponding blast regions are separated from each other by the wall, a more or less closed circuit for the blasting shot or sand is created, and the blasting shot or sand moves around this circuit without any separate conveyor outside the housing being necessary. The material to be blasted is blasted from both sides by the two opposed streams of blasting shot or sand which are separated from each other by the wall. Basically, the blasting shot sand which has to be supplied to the wheels from outside the housing is only in an amount equal to that which has worn away. Since the blasting shot or sand is not projected against itself in opposite directions, this wear is relatively small. The blasting machine in accordance with the present invention creates an uninterrupted circuit of blasting material, as a result of which the energy consumption is low and the dimensions of the machine can be kept small. The guide devices serve for distributing the blasting shot over as large as possible a circumferential extent of the wire or rod material to be blasted.

Each guide device preferably comprises two guide plates arranged face to face and a wedge-shaped piece disposed between them. The shot or sand passes between the plates and the provision of the wedge-shaped piece between the two guide plates ensures that the material to be blasted is subjected through a large peripheral angle of up to 270° to the blast from each centrifuge wheel.

In a preferred embodiment, an air impeller is mounted on one centrifuge wheel and an air intake opening is provided in the housing adjacent the impeller. Preferably, also the discharge of scale and the like takes place through an opening in the housing situated in a region which is shaded from the blasting shot by that guide device which is associated with the centrifuge wheel on which the air impeller is mounted. By the provision of the outlet opening in the shadow of this guide device, it is possible for the heavier blasting shot to be separated from the lighter scale or other abrasion products, since the lighter materials enter the shaded region and can be extracted from it without an appreciable proportion of the blasting shot accompanying them. In the outlet opening a sieve grating may be provided. The sieve grating passes the lighter and smaller materials and makes it possible to separate any blasting shot which may escape through the opening and still be reusuable. This shot can then be returned through a separate blasting shot line back to the shot inlet.

The air impeller acts to influence the air flow conditions in the housing in such a manner that the desired separation of blasting shot from the lighter scale and other abrasion products takes place.

BRIEF DESCRIPTION OF THE DRAWINGS

An example of a machine in accordance with the invention is illustrated in the accompanying drawings in which:

FIG. 1 is a front view of the apparatus with front cover plates removed to show internal details;

FIG. 2 is a section along the line A-B of FIG. 1;

FIG. 3 is a cross-section through a sieve grating device forming part of the apparatus, in the region of the outlet of the device; and, FIG. 4 is a vertical section through the device shown in FIG. 3.

DESCRIPTION OF A PREFERRED EMBODIMENT

The machine comprises a closed housing formed by an upright member 1, a frame 2 and cover plates 3. The housing is divided longitudinally by a dividing wall 4 into two sections. Inside the housing, two bladed centrifuge wheels 5 and 6, which rotate in the same direction as each other, are journalled at a distance one above the other.

The directions of throw of the centrifuge wheels are open one towards each of the two sections. Inlets to the two centrifuge wheels are each constructed as a funnel 7 and 8 respectively. The mouths of the funnels 7 and 8 extend beyond the central point of the centrifuge wheels and guide entrained blasting shot or sand from the inside into the centrifuge wheels for a circumferential distance at the most equal to the distance between two successive blades of the wheels.

A predetemined quantity of blasting shot or sand is fed through a connecting pipe 9 to the lower centrifuge wheel 6. The shot then flows in an uninterrupted circuit through both the housing sections and through the centrifuge wheels, in which it is continually accelerated. A wire or rod pulled through the housing is thus blasted directly from below and above as the shot or sand passes between the two wheels 5 and 6.

The mouth orientation of the funnels 7 and 8, the number and length of the centrifuge wheel blades and the circumferential speed of these wheels are so adapted one to another that the blasting shot or sand cannot quite flow directly outwards between two blades without contacting the blades, but is always picked up by the next following blade. The scatter distance of the blasting shot or sand issuing from the centrifuge wheels is approximately equal to the length of the wire or rod exposed to the blasting operation.

In the housing, the shot or sand stream in each section is divided by wedge-shaped pieces 10 into two halves and is guided inwards again by adjustable guide blades 11 on to the wire to be descaled. As a result, the wire or rod is blasted on two sides in each individual section through an arc of up to 270°. This results in highly effective all round blasting.

By this arrangement of the wedge-shaped pieces 10 and guide blades 11, a free flow of the blast stream is also promoted.

Since the centrifuge wheels act as in an air blower, a strong air stream accompanies the blasting operation, thus promoting the flow of blasting shot or sand. Air is sucked in through an aperture of variable width in the housing behind one centrifuge wheel. The airstream is for the greater part mutually compensated by the centrifuge wheels. However, in the blasting operation, a damming-up of air takes place, causing air and scale to escape into a sieve grating 12 disposed outside a scale outlet of the housing. The outlet opening in the housing is situated behind the guide blade 11. As a result, only the lighter scale and air escape from the housing, while the heavier blasting shot remains in the air stream. Any additional air necessary is sucked in by air blades or impellers 13 mounted behind the lower centrifuge wheel 6.

The sieve grating 12 is formed by arranging grating bars 14 to form a cylindrical body. At the ends of the bars, there are wedge-shaped spacers 15. The grating bars 14 can therefore be of rectangular section and a free passage for scale and air is assured. At its downstream end, the grating 12 is closed internally by a closure plate 16, while in front of this a pipe 17 leads from an opening back into the blasting housing. As a result, any useful blasting shot still remaining in the air flow from the housing is separated and supplied back into the blasting circuit. Scale and air can, by contrast, pass between the bars to a separator or a filter and be separated from one another.

As a result of the fact that inside the housing the entrained airstream is for the greater part mutually compensated by the two centrifuge wheels, a flow of air smaller than that from conventional machines of the kind described needs to be filtered.

In operation, worn blasting shot is replaced by new shot in a conventional manner through the inlet pipe 9, in an amount depending upon the power consumption of the centrifuge wheels. In this way, a mixed distribution of shot is maintained in the blasting region.

I claim:

1. In a shot blasting machine for blasting elongated rod-like material, said machine comprising a substantially closed housing, means rotatably mounting a first centrifuge wheel in said housing, means rotatably mounting a second centrifuge wheel in said housing spaced from said first centrifuge wheel to define a blasting zone in said housing between said centrifuge wheels, means defining an inlet for blasting shot to said housing, means for conducting said rod-like material through said blasting zone in said housing, and means defining an outlet from said housing for scale blasted from said rod-like material, the improvement comprising driving means for rotating said first centrifuge wheel and said second centrifuge wheel in the same direction as each other, wall means dividing said blasting zone into a first section and a second section, said wall means having means permitting the passage of said rod-like material therethrough, a first guide device disposed adjacent said first centrifuge wheel in said first section, and a second guide device disposed adjacent said second centrifuge wheel in said second section, said first guide device being operative to guide the blasting shot from said first centrifuge wheel through said blasting zone to said second centrifuge wheel and said second guide device being operative to guide shot from said second centrifuge wheel through said blasting zone to said first centrifuge wheel, whereby said blasting shot is circulated between said first and second centrifuge wheels and is accelerated thereby and through said blasting zone to blast said rod-like material conducted therethrough.

2. A machine as claimed in claim 1, wherein each of said guide devices comprises a first guide plate, a second guide plate, means mounting said guide plates face to face with a space between said plates, a wedge-shaped guide piece and means mounting said wedge-shaped guide piece in said space between said guide plates.

3. A machine as claimed in claim 1, and further comprising an air impeller, means mounting said air impeller to one of said centrifuge wheels for rotation therewith, and means defining an air inlet opening in said housing adjacent said air impeller whereby, in operation, said air impeller draws air through said air inlet opening into said housing and blows said air through said housing and out of said outlet for said scale, said outlet for said scale being in a portion of said housing which is shaded from the passage of said blasting shot between said centrifuge wheels by that one of said guide devices which is adjacent said centrifuge wheel to which said air impeller is mounted.

4. A machine as claimed in claim 3, further comprising sieve grating means and means mounting said sieve grating means across said outlet for said scale, said sieve grating means being operative to allow the passage of air and said scale therethrough and to prevent the passage therethrough of said blasting shot.

5. A machine as claimed in claim 4, further comprising means for collecting blasting shot, the passage of which is prevented by said sieve grating means and means for conducting said blasting shot collected by said collecting means to said blasting shot inlet of said housing.

* * * * *